US008777399B2

(12) United States Patent
Mo

(10) Patent No.: US 8,777,399 B2
(45) Date of Patent: Jul. 15, 2014

(54) SYSTEM AND METHOD FOR FIRST AND SECOND SIDE PROCESS REGISTRATION IN A SINGLE PRINT ZONE DUPLEX WEB PRINTER

(71) Applicant: Xerox Corporation, Norwalk, CT (US)

(72) Inventor: Song-Feng Mo, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 30 days.

(21) Appl. No.: 13/627,403

(22) Filed: Sep. 26, 2012

(65) Prior Publication Data

US 2014/0085368 A1 Mar. 27, 2014

(51) Int. Cl.
*B41J 2/01* (2006.01)

(52) U.S. Cl.
USPC ..... 347/104

(58) Field of Classification Search
CPC .... B41J 2029/3935; B41J 11/42; B41J 11/46; B41J 11/008; B41J 2/155; B41J 2/04573; B41J 29/38; B41J 29/393
USPC ..... 347/14, 104
See application file for complete search history.

(56) References Cited

U.S. PATENT DOCUMENTS

| | | | | |
|---|---|---|---|---|
| 5,570,172 | A | 10/1996 | Acquaviva | |
| 5,670,995 | A * | 9/1997 | Kupcho et al. | 347/5 |
| 6,823,786 | B1 | 11/2004 | Shmaiser et al. | |
| 8,223,351 | B2 | 7/2012 | Eun et al. | |
| 2010/0123752 | A1 | 5/2010 | Eun et al. | |
| 2010/0329756 | A1 * | 12/2010 | Mizes | 399/364 |
| 2011/0064507 | A1 | 3/2011 | McLaughlin | |
| 2011/0280638 | A1 | 11/2011 | Eun | |
| 2012/0051767 | A1 | 3/2012 | Gross et al. | |

* cited by examiner

*Primary Examiner* — Alessandro Amari
*Assistant Examiner* — Michael Konczal
(74) *Attorney, Agent, or Firm* — Maginot, Moore & Beck, LLP

(57) ABSTRACT

A method of printhead registration in a duplex printer enables process direction registration of a first group of printheads and a second group of printheads in a single print zone that print first and second sides of a print medium concurrently. The first group of printheads is registered to a first reference printhead based on the process direction locations of a first plurality of marks printed by the first group of printheads at a first time between printed images on the first side of the print medium. The second group of printheads is registered to a second reference printhead based on the process direction locations of a second plurality of marks printed by the second group of printheads at a second time between printed images on the second side of the print medium.

8 Claims, 4 Drawing Sheets

SYSTEM AND METHOD FOR FIRST AND SECOND SIDE PROCESS REGISTRATION IN A SINGLE PRINT ZONE DUPLEX WEB PRINTER

TECHNICAL FIELD

This disclosure relates generally to inkjet printers, and, more particularly, to inkjet printers that print duplex images.

BACKGROUND

Some inkjet printers perform duplex printing of a continuous media web, such as an elongated roll of paper, using a single pass with a single print zone that includes a single array of printheads. A media transport system including a series of rollers that moves the media web through the printer in a process direction. In the single-pass duplex configuration, the media transport moves the media web through the print zone for first-side printing by only a first group of printheads in the print zone. The media transport subsequently moves the media web through an inverter that flips the print medium to present the reverse surface for printing. The media transport then moves the inverted media web through the print zone a second time past a second group of printheads in the print zone for second-side printing. The first group of printheads and the second group of printheads are offset from each other in the cross-process direction with sufficient space to accommodate the first side and the second side of the continuous media web concurrently. Thus, the first and second groups of printheads operate concurrently to print on different portions of the first and second sides of the media web, respectively.

In order to maintain high quality printed output, the printer performs process direction registration of the multiple printheads in print zone. The process direction registration ensures that ink drops from different printheads land on predetermined locations of the media web as the media web moves past the printheads in the process direction. For example, in a multi-color configuration printheads that eject inks of two different colors are arranged at different locations along the media path. When the printheads are properly registered in the process direction, the relative timing of the operation of the inkjets from each printhead ensure that ink drops land on the predetermined locations of the media web as the media web passes both printheads at different times along the media path. Proper process direction registration enables the accurate reproduction of a wide range of colors using a smaller number of ink colors, such as cyan, magenta, yellow, and black (CMYK) inks. Errors in the process direction registration can, however, result in inaccurate color reproduction and other reductions in printed image quality.

In an existing process direction registration technique, all of the printheads in the print zone eject ink drops to form a printed test pattern on the media web, and an electronic controller adjusts the timing of the printheads relative to a reference printhead based on image data generated from the printed test pattern. As described above, the controller adjusts the relative timing of the printheads so that ink drops from different printheads arranged along the process direction land on the correct location of the print medium. In a single-pass duplex configuration, however, the two different sides of a single media web effectively act as two different print media. Existing methods require adjustments to the media path to ensure that the first side and the second side of the media web remain aligned with inter-document zones on both the first side and the second side of the media web passing through the print zone in tandem. The inter-document zones are blank regions of the media web between adjacent printed pages where the test patterns are printed without interfering with pages printed during a print job. The adjustment to the media path frequently requires manual intervention from an operator, which can reduce efficiency of operating the printer. Consequently, improvements to process direction registration techniques in inkjet printers that reduce or eliminate the need to align the first and second sides of the media web during a print job would be beneficial.

SUMMARY

In one embodiment, a method for operating a duplex printer has been developed. The method includes moving a print medium in a process direction past a plurality of printheads in a print zone to enable a first group of printheads in the plurality of printheads to eject ink onto a first side of the print medium and form a first plurality of marks on the first side of the print medium between a first printed image and a second printed image on the first side of the print medium, inverting the print medium, moving the inverted print medium in the process direction through the print zone to enable a second group of printheads in the plurality of printheads to eject ink onto a second side of the print medium concurrently as the first group of printheads ejects ink onto the first side of the print medium, the second group of printheads being offset from the first group of printheads in a cross-process direction and the second group of printheads forming a second plurality of marks on the second side of the print medium between a third printed image and a fourth printed image on the second side of the print medium, generating image data with an optical sensor, the image data corresponding to the first plurality of marks on the first side of the print medium, adjusting a time of operation for the first group of printheads with reference to the image data corresponding to the first plurality of marks to register the first group of printheads with a reference printhead in the first group of printheads, generating image data with the optical sensor, the image data corresponding to the second plurality of marks on the second side of the print medium, and adjusting a time of operation for the second group of printheads with reference to the image data corresponding to the second plurality of marks to register the second group of printheads with another reference printhead in the second group of printheads.

In another embodiment, a duplex printer has been developed. The printer includes a plurality of printheads that form a print zone, the plurality of printheads having a first group of printheads configured to eject ink onto a first side of a print medium and a second group of printheads configured to eject ink drops onto a second side of the print medium, the second group of printheads being offset from the first group of printheads in a cross-process direction, a media transport, an optical sensor configured to generate image data corresponding to light reflected from the first side and the second side of the print medium after the first side and the second side of the print medium have been printed by the first group and the second group of printheads, and a controller operatively connected to the plurality of printheads, the media transport, and the optical sensor. The media transport is configured to configured to move the print medium past the first group of printheads in the print zone in a process direction for printing the first side of the print medium, invert the print medium after the print medium passes out of the print zone, and move the inverted print medium in the process direction past the second group of printheads for printing the second side of the print medium, the first side of the print medium moving past the first group of printheads in the print zone concurrently with the second side of the print medium moving past the second group of printheads in the print zone. The controller is configured to operate the media transport to move the first side and second side of the print medium through the print zone, generate firing signals for the first group of printheads to eject ink drops at a first time to form a first plurality of marks on the first side of the print medium between a first printed image and a second printed image on the first side of the print medium, generate image data with the optical sensor, the image data corresponding to the first plurality of marks on the first side of the print medium, adjust a time of operation for the first group of printheads with reference to the image data corresponding to the first plurality of marks to register the first group of printheads with a reference printhead in the first group of printheads, generate firing signals for the second group of printheads to eject ink drops at a second time to form a second plurality of marks on the second side of the print medium between a third printed image and a fourth printed image on the second side of the print medium, generate image data with the optical sensor, the image data corresponding to the second plurality of marks on the second side of the print medium, and adjust a time of operation for the second group of printheads with reference to the image data corresponding to the second plurality of marks to register the second group of printheads with another reference printhead in the second group of printheads.

BRIEF DESCRIPTION OF THE DRAWINGS

The foregoing aspects and other features of method for registering printheads to form duplexed images on a media web are explained in the following description, taken in connection with the accompanying drawings.

DETAILED DESCRIPTION

Figure 1:
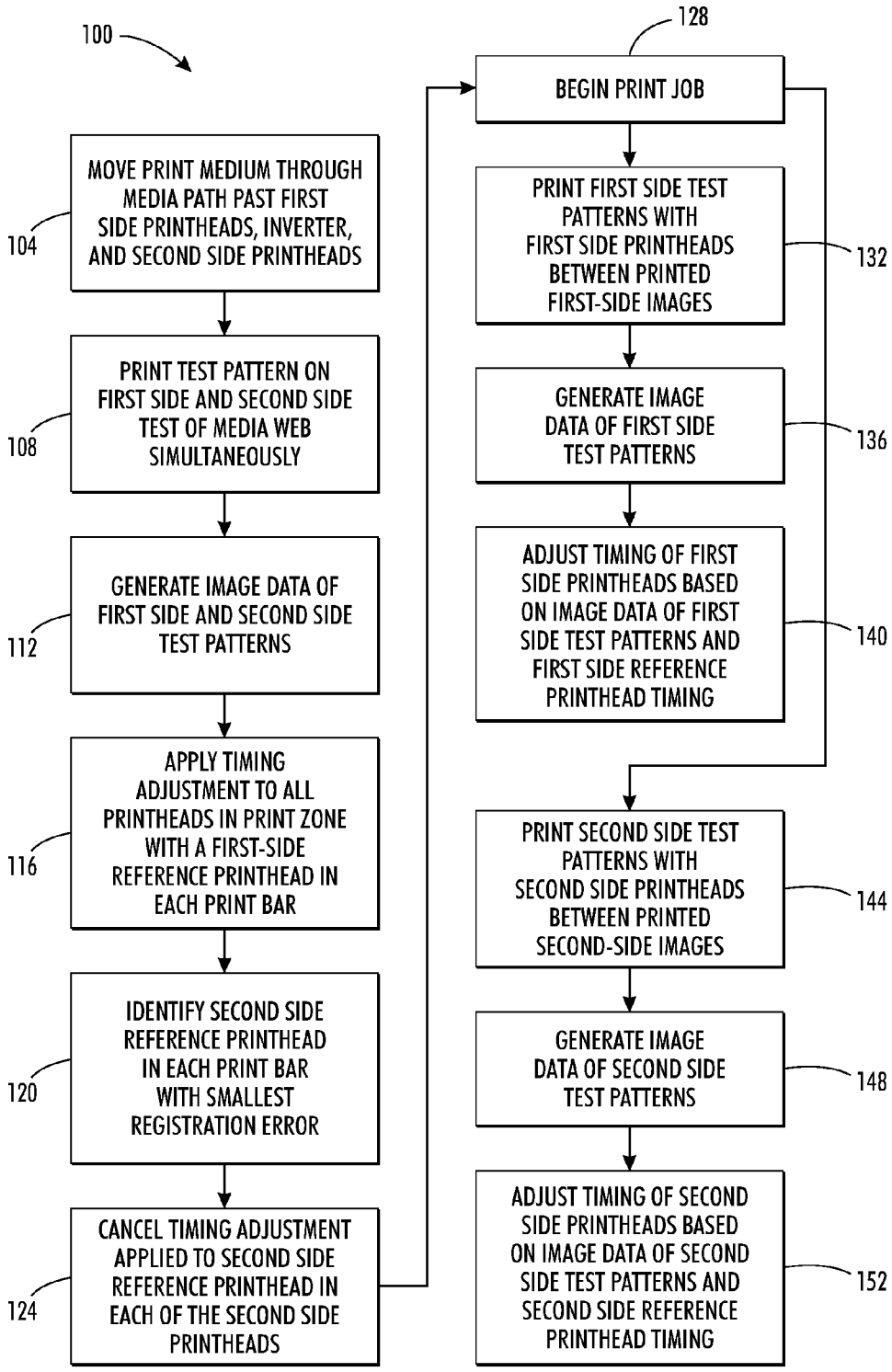
FIG. 1 is a block diagram of a process for registering printheads in a duplex printer.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, and the like. As used herein, the term "process direction" refers to a direction of movement of a print medium, such as a continuous media web pulled from a roll of paper or other suitable print medium along a media path through a printer. The print medium moves past one or more printheads in the print zone to receive ink images and passes other printer components, such as heaters, fusers, pressure rollers, and on-sheet imaging sensors, that are arranged along the media path. As used herein, the term "cross-process" direction refers to an axis that is perpendicular to the process direction along the surface of the print medium.

As used herein, the terms "upstream" and "downstream" refer to relative locations along a media path in a process direction through a continuous web printing system that can include one or more print zones. The media web moves in a process direction from a media source past a first group of printheads followed by a second group of printheads to a media collection site. The first group of printheads is upstream from the second group of printheads and the second group of printheads is downstream from the first group of printheads. In one configuration, a single print zone includes an array of printheads in which the first group of the printheads prints the first side of the print medium and the second group of the printheads prints the second, reverse, side of the print medium. The media path between the two groups of printheads includes an inverter that flips the web before the media web passes by the second group of printheads. To form the single print zone, the first group of printheads and the second group of printheads are positioned lateral to one another in a cross-process direction to enable portions of the first side and portions of the second side of the media web to be printed simultaneously during a duplex printing operation.

Figure 3:
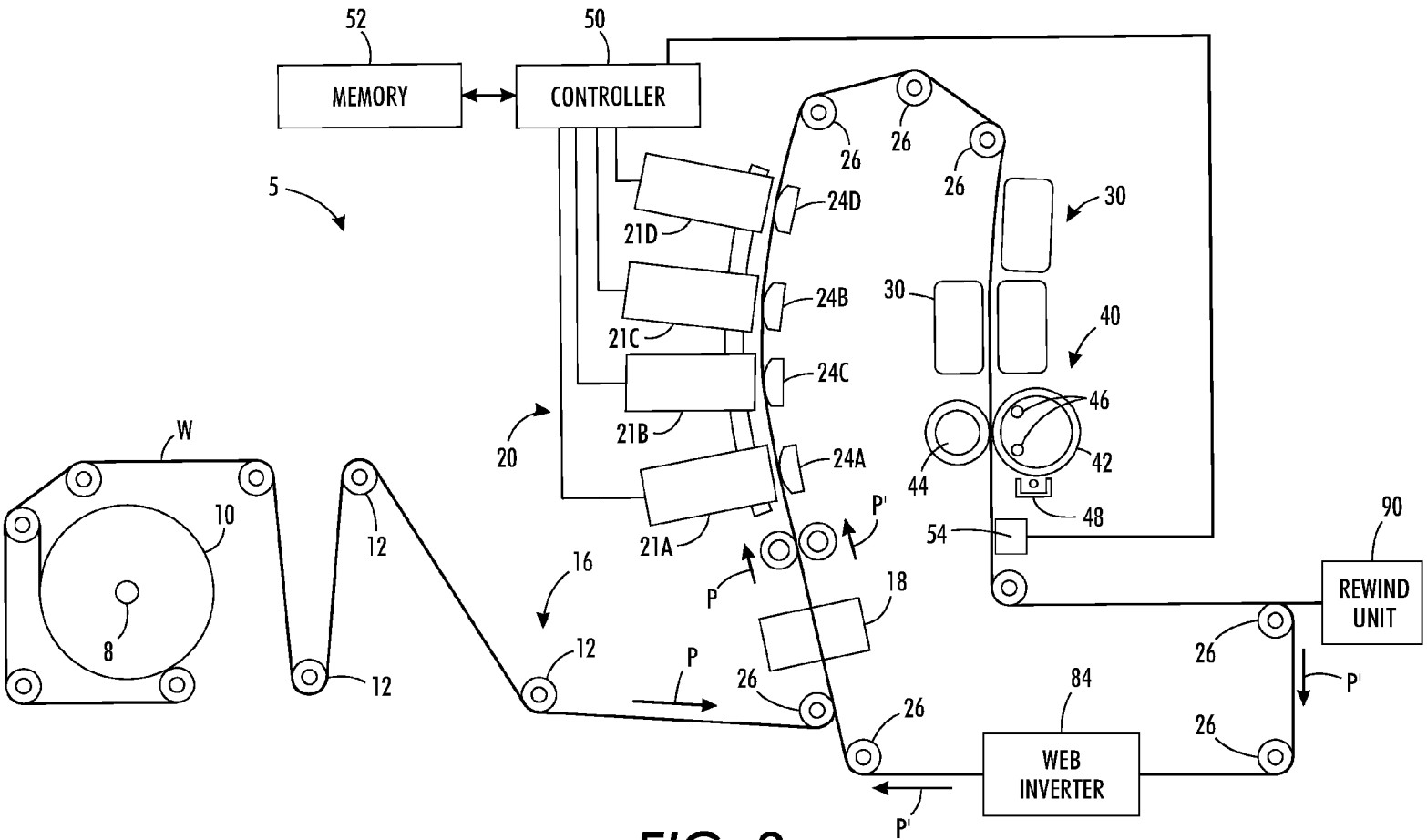
FIG. 3 PRIOR ART
FIG. 3 is a schematic diagram of a prior art continuous web printer.

FIG. 3 depicts a prior-art inkjet printer 5. For the purposes of this disclosure, an inkjet printer employs one or more inkjet printheads to eject drops of ink onto a surface of an image receiving member, such as paper, another print medium, or an indirect member, such as a rotating image drum or belt. The printer 5 is configured to print ink images with a "phase-change ink," by which is meant an ink that is substantially solid at room temperature and that transitions to a liquid state when heated to a phase change ink melting temperature for ejecting onto the imaging receiving member surface. The phase change ink melting temperature is any temperature that is capable of melting solid phase change ink into liquid or molten form. In one embodiment, the phase change ink melting temperature is approximately 70° C. to 140° C. In alternative embodiments, the ink utilized in the printer comprises UV curable gel ink. Gel inks are also heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

The printer 5 includes a controller 50 to process the image data before generating the control signals for the inkjet ejectors to eject colorants. Colorants can be ink or any suitable substance, which includes one or more dyes or pigments and which is applied to the media. The colorant can be black or any other desired color, and some printer configurations apply a plurality of different colorants to the media. The media includes any of a variety of substrates, including plain paper, coated paper, glossy paper, or transparencies, among others, and the media can be available in sheets, rolls, or other physical formats.

The printer 5 is an example of a direct-to-web, continuous-media, phase-change inkjet printer that includes a media supply and handling system configured to supply a long (i.e., substantially continuous) web of media 14 of "substrate" (paper, plastic, or other printable material) from a media source, such as spool of media 10 mounted on a web roller 8. The media web 14 includes a large number (e.g. thousands or tens of thousands) of individual pages that are separated into individual sheets with commercially available finishing devices after completion of the printing process. In the example of FIG. 3, the media web 14 is divided into a plurality of forms that are delineated with a series of form indicators that are arranged at predetermined intervals on the media web 14 in the process direction. Some webs include perforations that are formed between pages in the web to promote efficient separation of the printed pages.

For duplex operations, the web inverter 84 flips the media web 14 over to present a second side of the media to the print zone 20, before being taken up by the rewind unit 90. In duplex operation, the media source is approximately one-half of the width of the rollers over which the web travels so the web covers less than one-half of the surface of each roller 26 in the print zone 20. The inverter 84 flips and laterally displaces the media web 14 and the media web 14 subsequently travels over the other half of the surface of each roller 26 opposite the print zone 20, for printing and fixing of the reverse side of the media web 14. During first-side printing in the print zone 20, a first plurality of printheads in each of the printhead units 21A-21D form a first side image on the media web 14 during a first pass through the print zone 20 and the spreader 40. The web inverter 84 inverts and re-routes the second side of the media web 14 through a second plurality of printheads in each of the printhead units 21A-21D during a second pass through the print zone 20 and the spreader 40. Thus, the second pass of the media web is downstream of the first pass through print zone 20, which includes both a first group of printheads that print on the first side the media web 14 and a second group of printheads that print on the second side of the media web 14. The rewind unit 90 is configured to wind the web onto a roller for removal of the media web from the printer and subsequent processing.

Referring again to FIG. 3, the media web 14 is unwound from the source 10 as needed and a variety of motors, not shown, rotate one or more rollers 12 and 26 to propel the media web 14. The media conditioner includes rollers 12 and a pre-heater 18. The rollers 12 and 26 control the tension of the unwinding media as the media moves along a path through the printer. In alternative embodiments, the printer transports a cut sheet media through the print zone in which case the media supply and handling system includes any suitable device or structure to enable the transport of cut media sheets along a desired path through the printer. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media web 14 continues in the process direction P through the print zone 20 past a series of printhead units 21A, 21B, 21C, and 21D. Each of the printhead units 21A-21D effectively extends across the width of the media and includes one or more printheads that eject ink directly (i.e., without use of an intermediate or offset member) onto the media web 14. In printer 5, each of the printheads ejects a single color of ink, one for each of the colors typically used in color printing, namely, cyan, magenta, yellow, and black (CMYK).

The controller 50 of the printer 5 receives velocity data from encoders mounted proximately to the rollers positioned on either side of the portion of the path opposite the four printheads to calculate the linear velocity and position of the web as the web moves past the printheads. The controller 50 uses the media web velocity data to generate firing signals for actuating the inkjet ejectors in the printheads to enable the printheads to eject four colors of ink with appropriate timing and accuracy for registration of the differently colored patterns to form color images on the media. The inkjet ejectors actuated by the firing signals correspond to digital data processed by the controller 50. The digital data for the images to be printed can be transmitted to the printer, generated by a scanner (not shown) that is a component of the printer, or otherwise generated and delivered to the printer.

Associated with each printhead unit is a backing member 24A-24D, typically in the form of a bar or roll, which is arranged substantially opposite the printhead on the back side of the media. Each backing member positions the media at a predetermined distance from the printhead opposite the backing member. The backing members 24A-24D are optionally configured to emit thermal energy to heat the media to a predetermined temperature, which is in a range of about 40° C. to about 60° C. in printer 5. The various backer members can be controlled individually or collectively. The pre-heater 18, the printheads, backing members 24A-24D (if heated), as well as the surrounding air combine to maintain the media along the portion of the path opposite the print zone 20 in a predetermined temperature range of about 40° C. to 70° C.

As the partially-imaged media web 14 moves to receive inks of various colors from the printheads of the print zone 20, the printer 5 maintains the temperature of the media web 14 within a given range. The printheads in the printhead units 21A-21D eject ink at a temperature typically significantly higher than the temperature of the media web 14. Consequently, the ink heats the media, and temperature control devices can maintain the media web temperature within a predetermined range. For example, the air temperature and air flow rate behind and in front of the media web 14 impacts the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 applies heat and/or pressure to the media to fix the images to the media. The fixing assembly includes any suitable device or apparatus for fixing images to the media including heated or unheated pressure rollers, radiant heaters, heat lamps, and the like. In the embodiment of the FIG. 3, the fixing assembly includes a "spreader" 40, which applies a predetermined pressure, and in some implementations, heat, to the media. The function of the spreader 40 is to flatten the individual ink droplets, strings of ink droplets, or lines of ink on web 14 and flatten the ink with pressure and, in some systems, heat. The spreader flattens the ink drops to fill spaces between adjacent drops and form uniform images on the media web 14. In addition to spreading the ink, the spreader 40 improves fixation of the ink image to the media web 14 by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web 14 to a temperature in a range from about 35° C. to about 80° C. In alternative embodiments, the fixing assembly spreads the ink using non-contact heating (without pressure) of the media after the print zone 20. Such a non-contact fixing assembly can use any suitable type of heater to heat the media to a desired temperature, such as a radiant heater, UV heating lamps, and the like.

In one practical embodiment, the roller temperature in spreader 40 is maintained at an optimum temperature that depends on the properties of the ink, such as 55° C. Generally, a lower roller temperature gives less line spread while a higher temperature produces imperfections in the gloss of the ink image. Roller temperatures that are too high may cause ink to offset to the roll. In one practical embodiment, the nip pressure is set in a range of about 500 to about 2000 psi lbs/side. Lower nip pressure produces less line spread while higher pressure may reduce pressure roller life.

The spreader 40 can include a cleaning/oiling station 48 associated with image-side roller 42. The station 48 cleans and/or applies a layer of some release agent or other material to the roller surface. The release agent material can be an amino silicone oil having viscosity of about 10-200 centipoises. A small amount of oil transfers from the station to the media web 14, with the printer 5 transferring approximately 1-10 mg per A4 sheet-sized portion of the media web 14. In one embodiment, the mid-heater 30 and spreader 40 are combined into a single unit with their respective functions occurring relative to the same portion of media simultaneously. In another embodiment, the media is maintained at a high temperature as the media exits the print zone 20 to enable spreading of the ink.

The printer 5 includes an optical sensor 54 that is configured to generate image data corresponding to the first side and second side of the media web 14. The optical sensor 54 is configured to detect, for example, the presence, reflectance values, and/or location of ink drops jetted onto the media web 14 by the inkjets of the printhead assembly. The optical sensor 54 includes an array of optical detectors mounted to a bar or other longitudinal structure that extends across the width of an imaging area on the image receiving member. In one embodiment in which the imaging area is approximately twenty inches wide in the cross-process direction and the printheads print at a resolution of 600 dpi in the cross-process direction, over 12,000 optical detectors are arrayed in a single row along the bar to generate a single scanline of image data corresponding to a line across the image receiving member. The controller 50 generates two-dimensional image data from a series of scanlines that the optical sensor 54 generates as the first and second sides of the media web 14 move past the optical sensor 54. The optical detectors are configured in association in one or more light sources that direct light towards the first and second sides of the media web 14. The optical detectors receive the light generated by the light sources after the light is reflected from the image receiving member. The magnitude of the electrical signal generated by an optical detector corresponds to an amount of reflected light received by the detector from the bare surface of the media web 14 or ink markings formed on the media web 14. The magnitudes of the electrical signals generated by the optical detectors are converted to digital values by an appropriate analog/digital converter.

In printer 5, the controller 50 is operatively connected to various subsystems and components to regulate and control operation of the printer 5. The controller 50 is implemented with general or specialized programmable processors that execute programmed instructions. The instructions and data required to perform the programmed functions are stored in a memory 52 that is associated with the controller 50. The memory 52 stores programmed instructions for the controller 50. In the configuration of FIG. 3, the memory 52 also stores process direction registration data corresponding to the printheads in each of the printhead units 21A-21D. The process direction registration data include identified process direction registration errors between a first side reference printhead and other printheads in the print zone 20 that print on the first side of the media web 14, and identified process direction registration errors between a second side reference printhead and other printheads in the print zone 20 that print on the second side of the media web 14.

In the controller 50, the processors, their memories, and interface circuitry configure the controllers and/or print zone to perform the printer operations. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. The controller 50 is operatively connected to the printheads in the printhead units 21A-21D. The controller 50 generates electrical firing signals to operate the individual inkjets in the printhead units 21A-21D to eject ink drops that form printed images on the media web 14. As described in more detail below, the controller 50 receives signals from the optical sensor 54 to generate image data corresponding to test pattern marks formed on the first side and second side of the media web 14. The controller 50 performs process direction registration for the printheads in each of the printhead units 21A-21D to produce high quality printed images on both the first side and second side of the media web 14.

Figure 4:
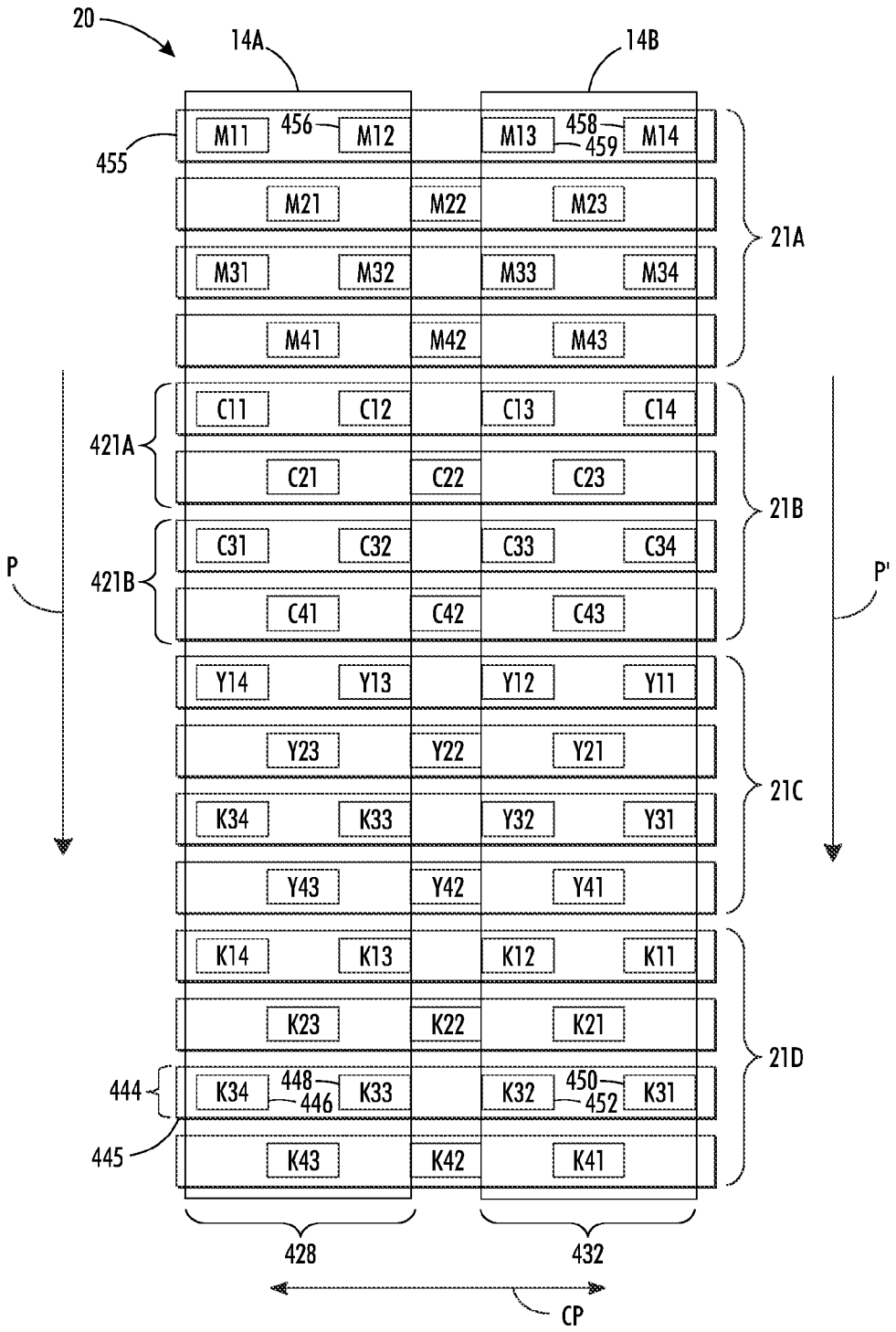
FIG. 4 PRIOR ART
FIG. 4 is a schematic diagram of a prior art print zone in the printer of FIG. 3.

FIG. 4 depicts a schematic view of the printhead units 21A-21D in the print zone 20. The printheads are arranged in staggered arrays to enable printing of a continuous line of ink across the print zone 20 in the cross-process direction CP. Each of the printhead units 21A-21D includes two sets of printheads that span the print zone 20 in the cross-process direction CP. For example, the cyan printhead unit 21B includes two sets of printheads 421A and 421B. The printheads 421A and 421B are interleaved in the cross-process direction CP to effectively double the printed resolution for the printhead unit. For example, if each printhead is configured to eject drops with a resolution of 300 drops per inch (DPI), then the interleaved printheads form printed images with a resolution of 600 DPI.

In the print zone 20, a series of support members arranged across the print zone 20 in the cross-process direction CP support either three or four printheads in one of the printhead units 21A-21D. The support members are also referred to as "printhead bars" and a "printhead bar unit" (PBU) refers to a single printhead bar and the plurality of printheads that are supported by the printhead bar. For example, in FIG. 4 a PBU 444 includes the support member 445 that supports four printheads 446, 448, 450, and 452 in the black printhead unit 21D.

FIG. 4 depicts the first side 14A and second side 14B of the media web 14 as the media web 14 passes through the print zone 20 for first side and second side printing. The first side 14A moves through the print zone 20 in the process direction P, and the second side 14B moves through the print zone 20 in the duplex process direction P', which is parallel to the process direction P. Thus, the first side 14A and second side 14B of the media web 14 both move through the print zone 20 in the same direction, and the second side 14B is offset from the first side 14A in the cross-process direction CP. In the print zone 20, a group of first side printheads 428 in each of the printheads units 21A-21D form marks and printed images on the first side 14A of the media web. Another group of second side printheads 432 in each of the printheads units 21A-21D form marks and printed images on the second side 14B of the media web.

Figure 2:
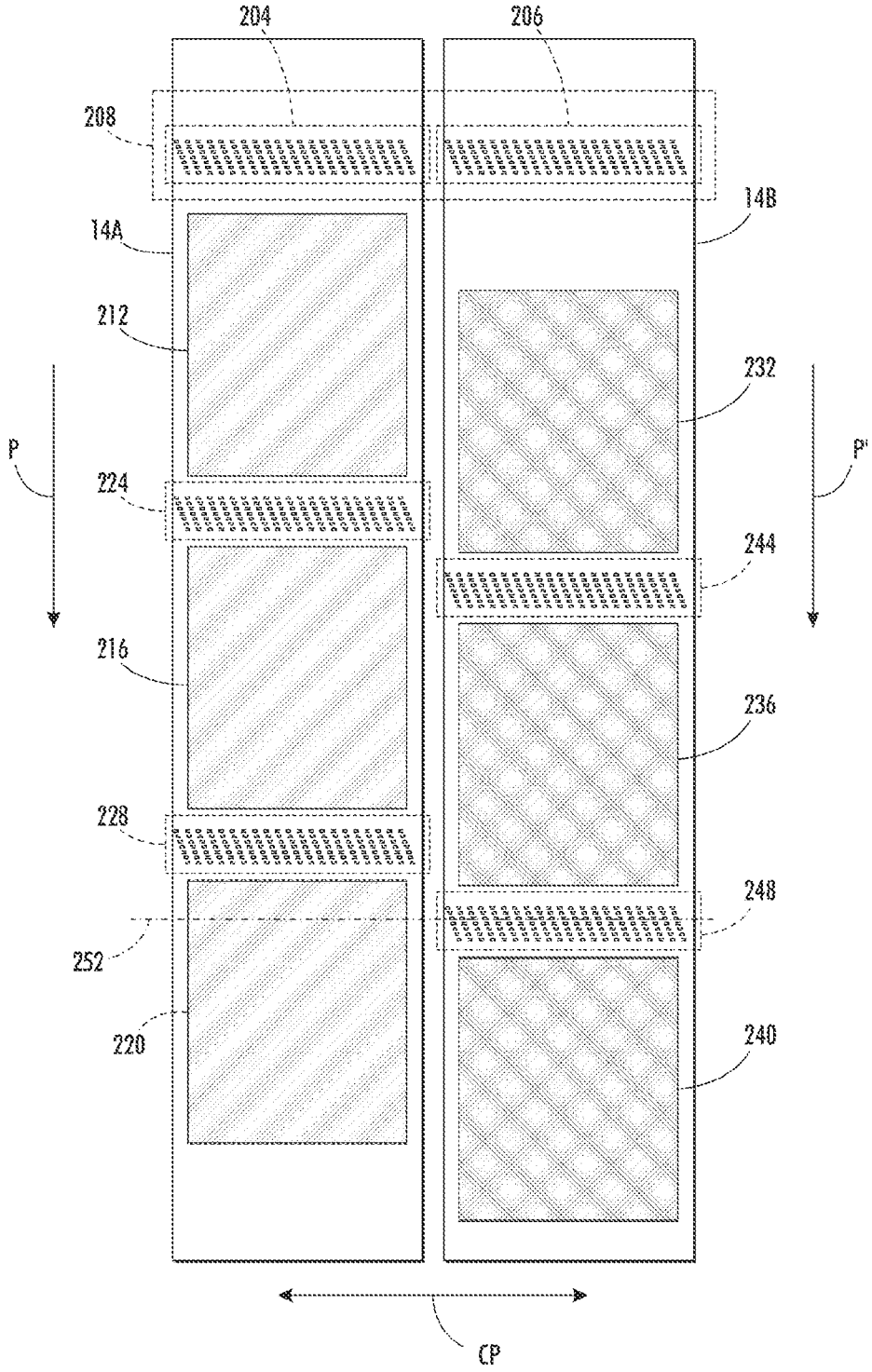
FIG. 2 is a plan view of a first side and a second side of a continuous print medium with printed marks formed by a duplex printer with a single print zone.

FIG. 2 depicts the first side and second side of the media web 14 in the duplex arrangement used in the print zone 20 of FIG. 4. FIG. 2 omits the printheads in the print zone 20 for clarity, and depicts printed images and test pattern marks that are formed on the first side 14A and second side 14B of the media web 14. In FIG. 2, a single test pattern 208 is printed on both the first side 14A and second side 14B of the media web 14. The first side printheads 428 print first side test patterns 224 and 228 on the first side 14A of the media web, and the second side printheads 432 print second side test patterns 244 and 248 on the second side 14B of the media web. During a print job, the first side printheads 428 in the printhead units 21A-21D also print first side images 212, 216, and 220 on the first side 14A of the media web, and the second side printheads 432 print second side images 232, 236, and 240 on the second side 14B of the media web.

FIG. 1 depicts a process 100 for process direction registration of printheads in a duplex print mode using a single print zone. In the discussion below, a reference to the process 100 performing a function or action refers to a controller executing programmed instructions stored in a memory to operate one or more components in a printer to perform the function or action. Process 100 is described in conjunction with the printer 5 for illustrative purposes.

Process 100 begins as the media web 14 moves through the print zone 20 along the process direction P for first-side printing, passes through the media web inverter 84, and returns to the print zone 20 along the duplex media path in the duplex process direction P' (block 104). A first portion of the first side of the media web 14 moves past the first group of printheads in each of the printhead units 21A-21D for first side printing on a first portion of the media web 14, and a second portion of the media web 14 passes the second group of printheads in each of the printhead units 21A-21D for second side printing of the media web 14. In the printer 5, the second portion of the media web 14 is downstream from the first portion of the media web 14 since the media web 14 passes through the web inverter 84 and returns the print zone 20 for second side printing. The first side printheads 428 and second side printheads 432 in the printhead units 21A-21D operate concurrently to form first side and second side images on different portions of the media web 14.

Process 100 continues as the printheads in the print zone 20 print a single test pattern including marks formed on both the first-side and the second-side of the media web (block 108). As depicted in FIG. 2, the test pattern 208 includes a first group of marks 204 and a second group of marks 206 that are formed on the first side 14A and second side 14B, respectively, of the media web 14. Since both groups of marks 204 and 206 are formed simultaneously, the test pattern 208 is located in a single region of the first side and second side of the media web 14 in the process direction P, and the groups of marks 204 and 206 are offset from each other in the cross-process direction CP. In the embodiment of FIG. 2, each printhead in the first side printheads 428 forms one or more marks in the group of marks 204. Similarly, each printhead in the second side printheads 432 forms one or more marks in the group of marks 206.

After printing the test pattern 208, the printer 5 generates image data corresponding to the test pattern 208 using the optical sensor 54 (block 112). The image data include a plurality of pixels that correspond to locations on the first side 14A and second side 14B of the media web 14, and to the marks formed in the test pattern 208.

The controller 50 uses the generated image data to identify a relative process direction offset of the printheads in the print zone 20 from a predetermined first side reference printhead. With reference to this relative process direction offset, the controller adjusts the timing of operation for inkjets in each printhead to register the printheads in the process direction (block 116). For example, in FIG. 4 a first-side printhead 456 that prints magenta ink marks in the test pattern 208 is used as the reference printhead. The controller 50 identifies the process direction location of marks in the image data that the printhead 456 forms in the test pattern 208. The controller 50 identifies process direction offsets from the reference printhead 456 for each of the other printheads in the print zone 20 based on the process direction location of marks formed by each of the other printheads.

The controller 50 then adjusts individual timing offsets in each of the printheads in the print zone 20 to compensate for the identified process direction errors between the expected location of ink marks formed by each printhead and the identified locations of the ink marks in the image data. For example, the controller 50 adjusts the time of operation for each of the printheads 446-452 in the PBU 444 so that inkjets in each of the printheads 446-452 operate at appropriate times to form marks that are registered to the marks from the reference printhead 456 in the process direction.

In the printer 5, the controller 50 stores data corresponding to the identified error between the reference printhead 456 and the other printheads in the print zone 20 in the memory 52. The process direction registration technique described with reference to the processing of block 116 is known to the art for use in printing on a single print medium that receives ink drops from each of the printheads in the print zone 20.

As described above, the controller 50 adjusts the timing of printheads in the print zone 20 to correct process direction errors. In one embodiment, each printhead further includes a printhead controller that is configured to adjust a time offset for operating the inkjets in the printhead using a predetermined number of discrete time delay increments. During the adjustment of the both first and second side printheads, the controller 50 sets the default delay value to a mid-point for each printhead. For example, if each printhead controller generates a delay with up to 32,000 time delay increments, then the both first and second side printheads are set with a default time delay value of 16,000. The controller 50 adjusts the time delay of each printhead relative to the default delay of 16,000 instead of zero. As described below, the default adjustment of the printheads enables adjustment of the time of operation of the inkjets in the second side printheads forward in time as well as backward in time.

Referring again to FIG. 1, process 100 continues with identification of a second side reference printhead in the same PBU that holds the first side reference printhead 456 (block 120). The second side reference printhead is identified as the second side printhead in the PBU with the smallest identified process direction registration error of the second side printheads of the reference PBU. In the printer 5, the memory 52 stores the error values for each of the second side printheads, and the controller 50 identifies the second side printhead with the minimum error of the reference PBU 455 using the data stored in the memory 52. A single support member in the reference PBU 455 supports both the first side printheads, including the reference printhead 456 and second side printheads 458 and 459.

As described above, each printhead in the group of second side printheads 432 is registered to the reference PBU, which is the most upstream PBU 455 in the example of FIG. 4. For second-side printing, the controller 50 uses a feed-forward controller to cancel the timing adjustment that is applied to the first side reference printhead 456 in each of the second side printheads 458 and 459 in the reference PBU 455 (block 124). For example, if the registration process introduces a delay of 512 time increments to the first side reference printhead 456 in the PBU 455, then the timing for each of the second side printheads 458 and 459 is brought forward by 512 time increments.

As described above, both the first and second side printheads 428 and 432 are initially adjusted with a time increment value in the middle of a range of discrete time increments. Thus, if one or more of the second side printheads 432 has a time offset of less than 512 time increments, the cancellation process does not introduce a new error in the relative time offset of the second side printhead. For example, in a configuration where the controller introduces a time delay of 256 time increments for the printhead 450, the printhead 450 has a total time delay of 16,256 time increments, with the default value of 16,000 time increments being increased by 256 time increments during the processing described above with reference to block 116. The controller 50 subtracts 512 increments from the time delay in the printhead 450 to cancel the time offset introduced in the second side printheads 458 and 459. Thus, the total time delay value in the printhead 450 is 15,744, which is a value that is greater than zero. Because the timing of the second side printheads 432 are adjusted, the absolute time delay values introduced for the second side printheads 432 do not reduce the process direction registration accuracy for second side printed test patterns and images.

The printing of the test pattern 208 using both the first side printheads 428 and second side printheads 432 occurs in a region of the media web 14 that is blank on both the first side 14A and second side 14B, such as during initial winding through the media path or between print jobs. Process 100 continues as the printer 5 begins a print job (block 128). During the print job, the first side printheads 428 form printed images on the first side 14A of the media web 14, such as the printed images 212, 216, and 220 depicted in FIG. 2. The second side printheads 432 form images on the second side 14B of the media web 14, such as images 232, 236, and 240 depicted in FIG. 2.

During the print job, the relative process direction location of the first side images and the second side images can vary due to variations in the length of the media web 14 in the media path. For example, as depicted in FIG. 2, the line 252 extends in the cross-process direction CP through a first side printed image 220 and a blank region, also referred to as an inter-document zone, between printed images 236 and 240 on the second side 14B. Thus, if all of the printheads in the print zone 20, including the printhead groups 428 and 432, were to repeat the test pattern 208 at the location of the line 252 in the process direction, the first side printheads 428 would form the test pattern over a printed image 220 while the second side printheads 432 would print in the inter-document zone between the images 236 and 240.

The process 100 maintains printhead registration between the first side printheads 428 and the second side printheads 432 by performing independent process-direction printhead registration operations on the first and second sides of the media web 14. In the printer 5, the controller 50 operates the first side printheads 428 to form first side test patterns in the inter-document zones between first side images, such as the test patterns 224 and 228 in FIG. 2 (block 132). The optical sensor 54 generates image data for the first side test patterns (block 136), and the controller 50 adjusts the timing of the first side printheads 428 to maintain process direction registration with the first side reference printhead 456 (block 140).

The processing described with reference to blocks 132-140 is similar to the processing described above with reference to the processing of blocks 108-116, although the controller 50 only performs the process direction registration for the first side printheads 428. The controller 50 operates the second side printheads 432 independently of the first side printheads 428 during the processing described with reference to blocks 132-140. For example, the second side printheads 432 may print second side images during the print job or print second side test patterns while the controller 50 performs process direction registration on the first side printheads 428.

During the print job, the controller 50 also operates the second side printheads 432 to form second side test patterns in the inter-document zones between second side images, such as the test patterns 244 and 248 in FIG. 2 (block 144). The optical sensor 54 generates image data for the second side test patterns (block 148), and the controller 50 adjusts the timing of the second side printheads 432 to maintain process direction registration with the second side reference printhead of the reference PBU 455, for example, if reference PBU is the most upstream PBU in the print zone, then the second side reference printhead is the head with smaller process registration error of the printheads of 458 and 459 (block 152).

The processing described with reference to blocks 144-152 is similar to the processing described above with reference to the processing of blocks 108-116, although the controller 50 only forms test patterns with the second side printheads 432 and only registers the second side printheads. The controller 50 operates the first side printheads 428 independently of the second side printheads 432 in a manner similar to the processing described above with reference to blocks 144-152.

The process 100 enables the printer 5 to perform a duplex print job using the single print zone 20 and to perform process direction registration for the first side and second side printheads without requiring precise alignment of the first side and second side printed images in the process direction. Instead, the printer 5 performs the process direction registration independently for the first side printheads and second side printheads during the print job to maintain process direction registration on both the first and second sides of the media web 14 during the print job.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A duplex inkjet printer comprising:

a plurality of printheads that form a print zone, the plurality of printheads having a first group of printheads configured to eject ink onto a first side of a print medium and a second group of printheads configured to eject ink drops onto a second side of the print medium, the second group of printheads being offset from the first group of printheads in a cross-process direction;

a media transport configured to:

move the print medium past the first group of printheads in the print zone in a process direction for printing the first side of the print medium;

invert the print medium after the print medium passes out of the print zone; and move the inverted print medium in the process direction past the second group of printheads for printing the second side of the print medium, the first side of the print medium moving past the first group of printheads in the print zone concurrently with the second side of the print medium moving past the second group of printheads in the print zone;

an optical sensor configured to generate image data corresponding to light reflected from the first side and the second side of the print medium after the first side and the second side of the print medium have been printed by the first group and the second group of printheads; and a controller operatively connected to the plurality of printheads, the media transport, and the optical sensor, the controller being configured to:

operate the media transport to move the first side and second side of the print medium through the print zone;

generate firing signals for the first group of printheads to eject ink drops at a first time to form a first plurality of marks on the first side of the print medium between a first printed image and a second printed image on the first side of the print medium;

generate image data with the optical sensor, the image data corresponding to the first plurality of marks on the first side of the print medium;

adjust a time of operation for the first group of printheads with reference to the image data corresponding to the first plurality of marks to register the first group of printheads with a reference printhead in the first group of printheads;

generate firing signals for the second group of printheads to eject ink drops at a second time to form a second plurality of marks on the second side of the print medium between a third printed image and a fourth printed image on the second side of the print medium;

generate image data with the optical sensor, the image data corresponding to the second plurality of marks on the second side of the print medium;

adjust a time of operation for the second group of printheads with reference to the image data corresponding to the second plurality of marks to register the second group of printheads with another reference printhead in the second group of printheads;

generate firing signals for the first group of printheads and the second group of printheads to eject ink drops from the first group of printheads and the second group of printheads simultaneously to form a third plurality of marks on the first side of the print medium and the second side of the print medium;

generate image data with the optical sensor, the image data corresponding to the third plurality of marks;

adjust a time of operation for the first group of printheads with reference to the image data corresponding to the third plurality of marks to register the first group of printheads with the reference printhead in the first group of printheads; and identify the reference printhead in the second group of printheads with reference to a minimum process direction registration error identified from the image data of the third plurality of marks.

2. The printer of claim 1 further comprising:

a member arranged in the cross-process direction in the print zone to support the reference printhead in the first group of printheads; and the controller is further configured to identify the reference printhead in the second group of printheads from a plurality of printheads in the second group of printheads that are supported by the member.

3. The printer of claim 1, the controller being further configured to:

adjust the time of operation for both the first group of printheads and the second group of printheads with reference to the image data corresponding to the third plurality of marks to register the first group of printheads and the second group of printheads with the reference printhead in the first group of printheads; and adjust the time of operation for only the second group of printheads to cancel the adjustment of the first group of printheads.

4. The printer of claim 3 further comprising:

a printhead controller associated with each printhead in the print zone, the controller being operatively connected to each printhead controller and further configured to:

set a relative time offset value in the printhead controller associated with each of the printheads to a value that is between a minimum time offset value and a maximum time offset value prior to ejecting the ink drops to form the third plurality of marks.

5. The printer of claim 4, the controller being further configured to:

reduce the relative time offset value in the printhead controller associated with a second printhead in the second group of printheads by an amount corresponding to an increase in a relative time offset in another printhead controller associated with a corresponding first printhead in the first group of printheads to cancel the adjustment applied to the first printhead in the second printhead.

6. The printer of claim 5, the second printhead in the second group of printheads and the corresponding first printhead in the first group of printheads being supported by a single member arraigned in the cross-process direction in the print zone.

7. A duplex inkjet printer comprising:

a plurality of printheads that form a print zone, the plurality of printheads having a first group of printheads configured to eject ink onto a first side of a print medium and a second group of printheads configured to eject ink drops onto a second side of the print medium, the second group of printheads being offset from the first group of printheads in a cross-process direction;

a media transport configured to:

move the print medium past the first group of printheads in the print zone in a process direction for printing the first side of the print medium;

invert the print medium after the print medium passes out of the print zone; and move the inverted print medium in the process direction past the second group of printheads for printing the second side of the print medium, the first side of the print medium moving past the first group of printheads in the print zone concurrently with the second side of the print medium moving past the second group of printheads in the print zone;

an optical sensor configured to generate image data corresponding to light reflected from the first side and the second side of the print medium after the first side and the second side of the print medium have been printed by the first group and the second group of printheads;

a controller operatively connected to the plurality of printheads, the media transport, and the optical sensor, the controller being configured to:

operate the media transport to move the first side and second side of the print medium through the print zone;

generate firing signals for the first group of printheads to eject ink drops at a first time to form a first plurality of marks on the first side of the print medium between a first printed image and a second printed image on the first side of the print medium, the firing signals being generated when a printed image formed on the second side of the print medium moves past the second group of printheads in the process direction;

generate image data with the optical sensor, the image data corresponding to the first plurality of marks on the first side of the print medium;

adjust a time of operation for the first group of printheads with reference to the image data corresponding to the first plurality of marks to register the first group of printheads with a reference printhead in the first group of printheads;

generate firing signals for the second group of printheads to eject ink drops at a second time to form a second plurality of marks on the second side of the print medium between a third printed image and a fourth printed image on the second side of the print medium;

generate image data with the optical sensor, the image data corresponding to the second plurality of marks on the second side of the print medium;

adjust a time of operation for the second group of printheads with reference to the image data corresponding to the second plurality of marks to register the second group of printheads with another reference printhead in the second group of printheads.

8. A duplex inkjet printer comprising:

a plurality of printheads that form a print zone, the plurality of printheads having a first group of printheads configured to eject ink onto a first side of a print medium and a second group of printheads configured to eject ink drops onto a second side of the print medium, the second group of printheads being offset from the first group of printheads in a cross-process direction;

a media transport configured to:

move the print medium past the first group of printheads in the print zone in a process direction for printing the first side of the print medium;

invert the print medium after the print medium passes out of the print zone; and move the inverted print medium in the process direction past the second group of printheads for printing the second side of the print medium, the first side of the print medium moving past the first group of printheads in the print zone concurrently with the second side of the print medium moving past the second group of printheads in the print zone;

an optical sensor configured to generate image data corresponding to light reflected from the first side and the second side of the print medium after the first side and the second side of the print medium have been printed by the first group and the second group of printheads;

a controller operatively connected to the plurality of printheads, the media transport, and the optical sensor, the controller being configured to:

operate the media transport to move the first side and second side of the print medium through the print zone;

generate firing signals for the first group of printheads to eject ink drops at a first time to form a first plurality of marks on the first side of the print medium between a first printed image and a second printed image on the first side of the print medium, the firing signals being generated when a printed image formed on the second side of the print medium moves past the second group of printheads in the process direction;

generate image data with the optical sensor, the image data corresponding to the first plurality of marks on the first side of the print medium;

adjust a time of operation for the first group of printheads with reference to the image data corresponding to the first plurality of marks to register the first group of printheads with a reference printhead in the first group of printheads;

generate firing signals for the second group of printheads to eject ink drops at a second time to form a second plurality of marks on the second side of the print medium between a third printed image and a fourth printed image on the second side of the print medium, the firing signals being generated when a printed image formed on the first side of the print medium moves past the first group of printheads in the process direction;

generate image data with the optical sensor, the image data corresponding to the second plurality of marks on the second side of the print medium;

adjust a time of operation for the second group of printheads with reference to the image data corresponding to the second plurality of marks to register the second group of printheads with another reference printhead in the second group of printheads.

* * * * *